US011732848B1

(12) United States Patent
Davidson

(10) Patent No.: US 11,732,848 B1
(45) Date of Patent: Aug. 22, 2023

(54) FLAGPOLE LIGHTING SYSTEM

(71) Applicant: DDM Ventures, LLC., Provo, UT (US)

(72) Inventor: Brent Davidson, Provo, UT (US)

(73) Assignee: DDM VENTURES LLC, Provo, UT (US)

( * ) Notice: Subject to any disclaimer, the term of this patent is extended or adjusted under 35 U.S.C. 154(b) by 0 days.

(21) Appl. No.: 18/122,274

(22) Filed: Mar. 16, 2023

(51) Int. Cl.

| | |
|---|---|
| ***F21S 4/10*** | (2016.01) |
| ***F21V 21/00*** | (2006.01) |
| ***F21Y 115/10*** | (2016.01) |
| ***F21Y 103/00*** | (2016.01) |
| ***F21W 131/10*** | (2006.01) |

(52) U.S. Cl.
CPC ..... *F21S 4/10* (2016.01); *F21V 21/00* (2013.01); *F21W 2131/10* (2013.01); *F21Y 2103/00* (2013.01); *F21Y 2115/10* (2016.08)

(58) Field of Classification Search
CPC ..... F21S 4/10; F21V 21/00; F21W 2131/10; F21Y 2103/00; F21Y 2115/10
See application file for complete search history.

(56) References Cited

U.S. PATENT DOCUMENTS

| | | | | |
|---|---|---|---|---|
| 1,843,389 | A * | 2/1932 | Fischer | F21S 4/10 439/505 |
| 5,245,519 | A * | 9/1993 | Openiano | F21S 4/10 362/249.16 |
| 8,678,615 | B1 | 3/2014 | Ko | |
| 9,523,486 | B2 | 12/2016 | Boyink | |
| 10,907,779 | B2 * | 2/2021 | Jackson | F21S 4/10 |
| 2014/0272202 | A1 | 9/2014 | Tsai | |
| 2015/0216346 | A1 | 8/2015 | Taylor | |
| 2017/0248284 | A1 | 8/2017 | Baldwin | |
| 2020/0263841 | A1 | 8/2020 | Jackson | |

* cited by examiner

*Primary Examiner* — Peggy A Neils
(74) *Attorney, Agent, or Firm* — Jason P. Webb; Pearson Butler

(57) ABSTRACT

A flagpole lighting assembly, including an enclosure which includes a ring-shaped base having an aperture therethrough which includes a circumferential region, and a bottom aperture interior to the circumferential region, and a cover which includes a top with an aperture therethrough, an outer wall circumferentially coupled to the top, with a larger diameter than a diameter of the circumferential region of the base, protruding downwards beyond the base, a primary protrusion extending from the top such that it is flush with the outer wall and including an aperture therethrough, and a plurality of secondary protrusions extending downward from the top, each protrusion having a brace connected to the outer wall, and a ring-shaped circuit board and a plurality of output lighted strands connected to the circuit board.

20 Claims, 5 Drawing Sheets

FLAGPOLE LIGHTING SYSTEM

BACKGROUND OF THE INVENTION

Field of the Invention

The present invention relates generally to a lighting system, specifically to lighting systems installed on flagpoles.

Description of the Related Art

When installing lighting during the holidays or for other special occasions, there is sometimes a lack of space or foliage to install on. For example, smaller city lots might have limited space in the yard and no trees or bushes, or industrial lots might have no green area at all. This makes it difficult to install impressive lighting systems that give viewers a pleasant experience.

Solutions to this include collapsible or constructed trees, blow up lighting decorations, spring and pulley systems, and systems mounted from panels. These systems create standalone decorations; however, have many drawbacks which make them unsuitable for most people. Examples of references related to the present invention are listed below, and the supporting teachings of each reference are incorporated by reference.

U.S. Pat. No. 8,678,615B1, to Ko, discloses a string light type Christmas tree kit for raising upon and being supported from a flagpole with rope and pulley for raising and lowering a flag. The kit includes a crown connector for connection of ends of multiple string lights and raising to at topmost position by the rope and pulley. A circular hoop structure is connected to lower ends of the string lights and is raised off the ground when the crown connector is raised to the topmost position, forming a conical, lighted structure providing the visual illusion of a lighted Christmas tree supported from a flagpole.

U.S. Pat. No. 9,523,486B2, to Boyink, discloses a lighting system comprises a crown including a plurality of connectors for engaging a plurality of light strands. The lighting system further comprises a plurality of light strands extending between first and second ends. The first ends of the light strands are removably engageable with the connectors of the crown. Each of the light strands includes at least one lighting element. Finally, the lighting system also comprises a controller in electrical communication with the crown for selectively controlling the lighting elements of the light strands. The present invention additionally provides a decorative article including the lighting system.

US Patent Application No. 20140272202A1, to Tsai et al. discloses a collapsible Christmas tree has a main trunk, a base, and multiple string lights. The main trunk is telescopic. The base is detachably mounted on a bottom end of the main trunk. The string lights are connected to the main trunk and the base. Two ends of each string light are respectively connected to a top end of the main trunk and the base. The main trunk and the base can be disassembled from each other. Additionally, the main trunk is telescopic, such that the overall volume can be further reduced when the collapsible Christmas tree is folded. As a result, the collapsible Christmas tree is convenient both for storage and transportation.

US Patent Application No. 20170248284A1, to Baldwin, discloses a lighting system comprising of a plurality of lights situated on one or more detachably connectable, modular, lighting panels.

US Patent No. 20200263841 A1, to Jackson, discloses a device to be affixed to an extension pole to support string lights, the device including a base member, a receiving portion formed in a bottom of the base member and configured to receive an end of an extension pole, and a plurality of hook members extending laterally from the base member and curving upwards to form a receiving portion configured to receive and support a portion of string lights.

US Patent Application No. 20150216346A1, to Taylor, discloses an ornamental Christmas tree with a hollow interior that is adapted to be suspended from a support. The device includes a cording system attached to a base board. The cording system includes a plurality of elongated cords threaded halfway through a ring support and one or more wraparound cords. The elongated cords are supported by a ring support, such that the cords angle outward therefrom and towards the base to form a conical representation of a Christmas tree with an open interior. Wraparound cords are positioned around the outer perimeter of the device in a spiral or multiple ring configuration. In a suspended state, the ring support is booked onto an overhead support. A user can decorate the device as the user would normally decorate a Christmas tree and fill the interior of the simulated tree with holiday decorations or presents.

The inventions heretofore known suffer from a number of disadvantages, including but not limited to: complicated or intricate installation procedures, requiring multiple people to properly install, being suitable to install on only one size or design structure, not including design choices such as size and color in the installation, requiring multiple addons to customize or work in other situations, being expensive, being unsuitable for inclement weather, easily damaged, and being bulky and difficult to move and/or store.

What is needed is a system and/or method that solves one or more of the problems described herein and/or one or more problems that may come to the attention of one skilled in the art upon becoming familiar with this specification.

SUMMARY OF THE INVENTION

There may be a flagpole lighting assembly, which may include a toroidal enclosure, which may include a ring-shaped base having an aperture therethrough, which may include a circumferential region, a bottom aperture which may be interior to the circumferential region, a cover which may include a top which may have a top aperture therethrough, an outer wall which may be circumferentially coupled to the top, with a larger diameter than a diameter of the circumferential region of the base, protruding downwards beyond the base, and a tubular inner wall which may extend downward from the aperture and may protrude through and/or beyond the bottom aperture, a ring-shaped circuit board which may be disposed within the toroidal enclosure, a plurality of output lighted strands which may be functionally coupled to the circuit board and may extend therefrom, and a power wire which may be functionally coupled to the circuit board, the enclosure may include a plurality of tabs which may extend upwards from the circumferential region, the base may include a plurality of ring-shaped protrusions which may extend upwards from the base and may include an aperture in the center thereof, the cover may include a plurality of mounts, the cover mount may connect the cover to the enclosure, the mounts may have are a plurality of protrusions which may extend downward from the top, each protrusion may have a brace connected to the outer wall, the circumferential region may include a plurality of cutouts therein, the base may include a plurality of ring-shaped protrusions which may extending upwards from the base, the ring-shaped protrusions may include an aperture in the center thereof.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
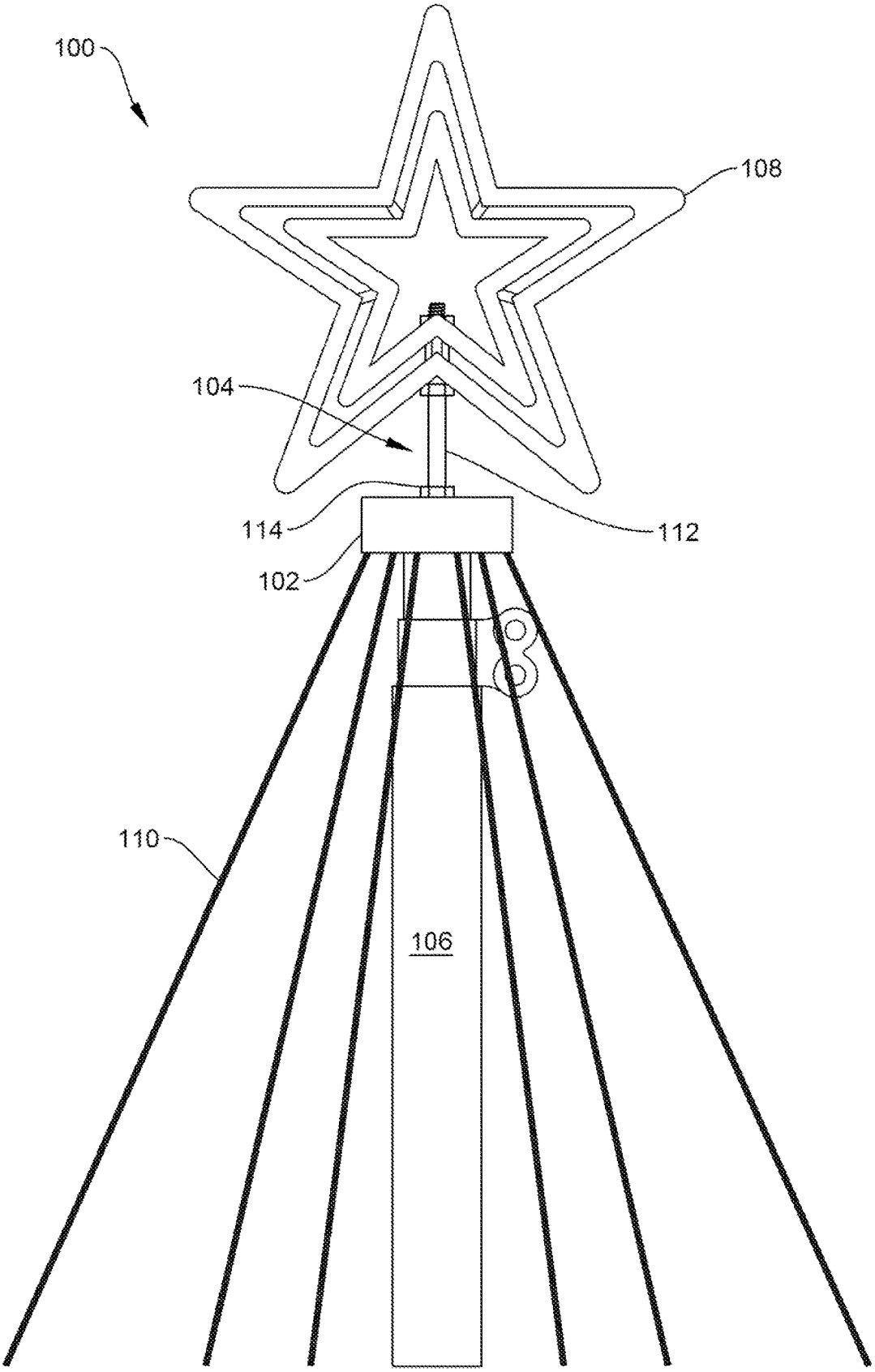
FIG. 1 is a side perspective view of a flagpole lighting assembly, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims or may be learned by the practice of the invention as set forth hereinafter.

FIG. 1 is a side perspective view of a flagpole lighting assembly 100, according to one embodiment of the invention. There is shown an enclosure 102 connected to a mount 104 and a pole 106, an illuminated top 108 connected to the mount 104, and an lighted strand 110 connected to the enclosure. Advantageously, the flagpole lighting assembly 100 provides a way to decorate a new or existing flagpole or other similar device that is simple and efficient to use, wherein the assembly may be done quickly by a single user without tools.

The illustrated enclosure 102 houses the critical lighting components, such as but not limited to: a circuit board, remote receiver, battery, lighting connections, Bluetooth cards or receivers, WiFi cards or receivers, or other wireless connections, and the like and combinations thereof such that they are protected and not vulnerable to damage nor exposed to the elements. Such embodiments may require the use of an onboard processor or small computerized device. Wireless control through remotes, phones, or other devices is shown to be completed through the enclosure 102.

The enclosure 102 as shown is watertight from the top, such that the top and sides of the device cannot be penetrated by water, with a partially open bottom such that water or air may get into the device from below. However, in other embodiments it may be fully watertight or may leave components exposed to the weather. The enclosure 102 further includes a connection for the input power cable as well as the necessary connections for any powered devices that the flagpole lighting assembly 100 may have included.

As shown, the enclosure 102 acts as the hub of the device, through which most of the other connections are made, however in other embodiments the enclosure may be more of an accessory piece, with the enclosure being incorporated into the illuminated top 108 or the pole 106. There are embodiments where there is no enclosure 102, such that the housed components are incorporated elsewhere. The enclosure 102 is illustrated as being made of plastic such that it has a high strength-to-weight ration and is relatively inexpensive to produce, however other materials may be used such as metals, rubbers, ceramics, and the like.

The illustrated mount 104 is shown connecting the enclosure 102 to the pole 106 and to the illuminated top 108. The mount 104 is shown as being a rod 112 which is threaded on both ends such that nuts 114 may be threaded onto each end to secure it. In other embodiments, there may be many other types of mounts 104, such as clips, clamps, clasps, adhesives, friction fit, other mechanical fasteners, and the like and combinations thereof. Further, there are embodiments where there is no separate mount 104, such that the other pieces of the flagpole lighting assembly 100 are affixed directly to or integrated with the pole 106. An example of such a system is the enclosure 102 including adhesive or structure to mount to the flagpole top, such that the mount 104 is not necessary to secure it.

The rod 112 is shown as threading into the top of the pole 106, with a nut 114 tightened down to secure it. The rod 112 is through an aperture of the enclosure 102 such that it also affixes the enclosure 102 to the pole 106. The other end of the rod 112 is shown affixed through an aperture of the illuminated top 108, with a nut 114 on each side of the aperture and tightened down to stabilize it. In other embodiments, the rod 112 may just be threaded into both the pole 106 and the illuminated top 108 such that there are no nuts 114 necessary to secure it.

The illustrated pole 106 is shown connected to the enclosure 102 via the mount 104. As shown, the pole 106 is a generic flagpole, however, may be any number of vertical structures such that the enclosure 102, mount 104, or illuminated top 108 may be mounted thereon and the lighted strands 110 may be pulled out such that the desired lighting arrangement may be made.

The illustrated illuminated top 108 is shown connected to the pole 106 through the mount 104. The illuminated top 108 is shown as including an aperture through which the mount 104 may be affixed. The illuminated top 108 is shown as mounted above the enclosure 102, mimicking a star-shaped tree-topper. However, in other embodiments, the illuminated top 108 may be any number of shapes and sizes and include various mounting methods, and in some embodiments is not illuminated. Other embodiments do not even include an illuminated top 108, such that the only lights come from the lighted strands 110.

The shown illuminated top 108 is electrically connected to the enclosure 102 such that it receives power for any lights, sound, movement, or the like included thereon. This allows the device to continue to work without an illuminated top 108 if it is not installed or is damaged. This also allows a plurality of interchangeable illuminated tops 108 to be used and installed or disassembled easily and quickly such that the flagpole lighting assembly 100 may be used multi-occasionally with minimal effort required to change in the desired parts.

In operation, the illustrated flagpole lighting assembly 100 is removed from a carrying case and carried to the top of a pole 106, where the existing finial or cap is removed from the pole 106 and the enclosure 102 set over the now exposed hole in the pole 106 such that the mount 104 may be threaded through the enclosure 102 and into the pole 106. Once the enclosure is mounted, the illuminated top 108 is set onto the mount 104 and affixed thereto.

Once each of the pieces are affixed to the pole 106, a lead on the enclosure 102 is connected to the illuminated top 108 such that it may receive power from the enclosure 102. The input power lead from the enclosure 102 is then connected to power such that the flagpole lighting assembly 100 is powered. A remote is then used to turn on and off the device, customize light settings such as color, lighting modes, and which strands are lit.

Advantageously, the illustrated flagpole lighting assembly 100 provides a lightweight, weather resistant, and attractive decorative setup that is simple to setup, modify, and store. The assembly 100 allows for a single user to transport and use it and may fit almost any pole 104 shapes and sizes as well as numerous other mounting locations.

Figure 2:
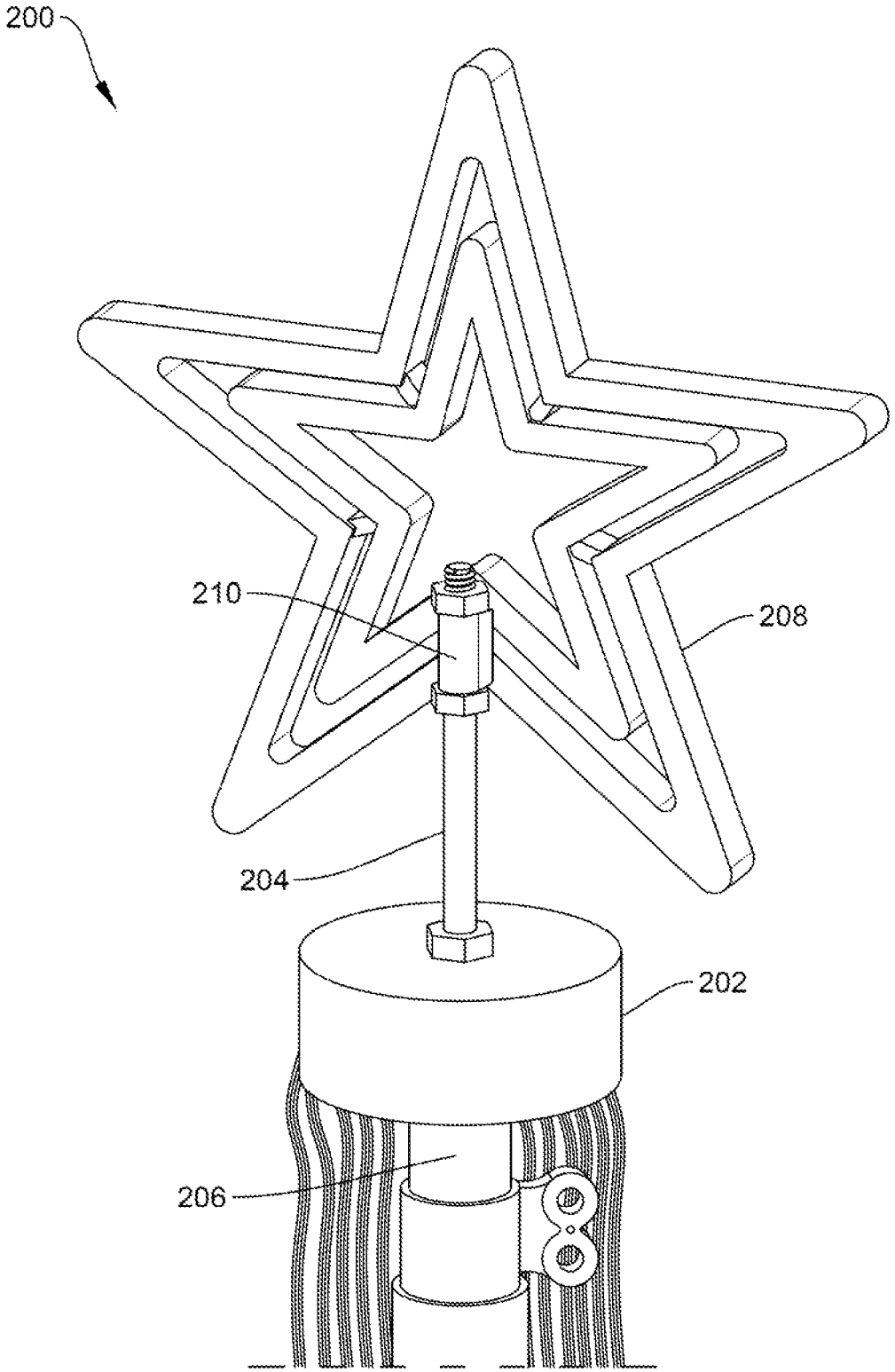
FIG. 2 is a top perspective view of a flagpole lighting assembly, according to one embodiment of the invention.

FIG. 2 is a top perspective view of a flagpole lighting assembly 200, according to one embodiment of the invention. As illustrated, the flagpole lighting assembly 200 includes an enclosure 202, a mount 204, a pole 206, and an illuminated top 208. The mount 204 connects the enclosure 202 and illuminated top 208 to the pole 206 such that they are secured and resistant to movement.

As shown, the enclosure 202 is toroidal in shape and has an aperture through which the mount 204 may be inserted through such that it may be connected to the pole 206. Further the illuminated top 208 has a connector 210 with an aperture through which the mount 204 may connect through.

Accordingly, the mount 204 is separate from the electronic portions of the flagpole lighting assembly 200 such that multiple different styles of mounts 204 may be used depending on a user's specific setup requirements.

Figure 3:
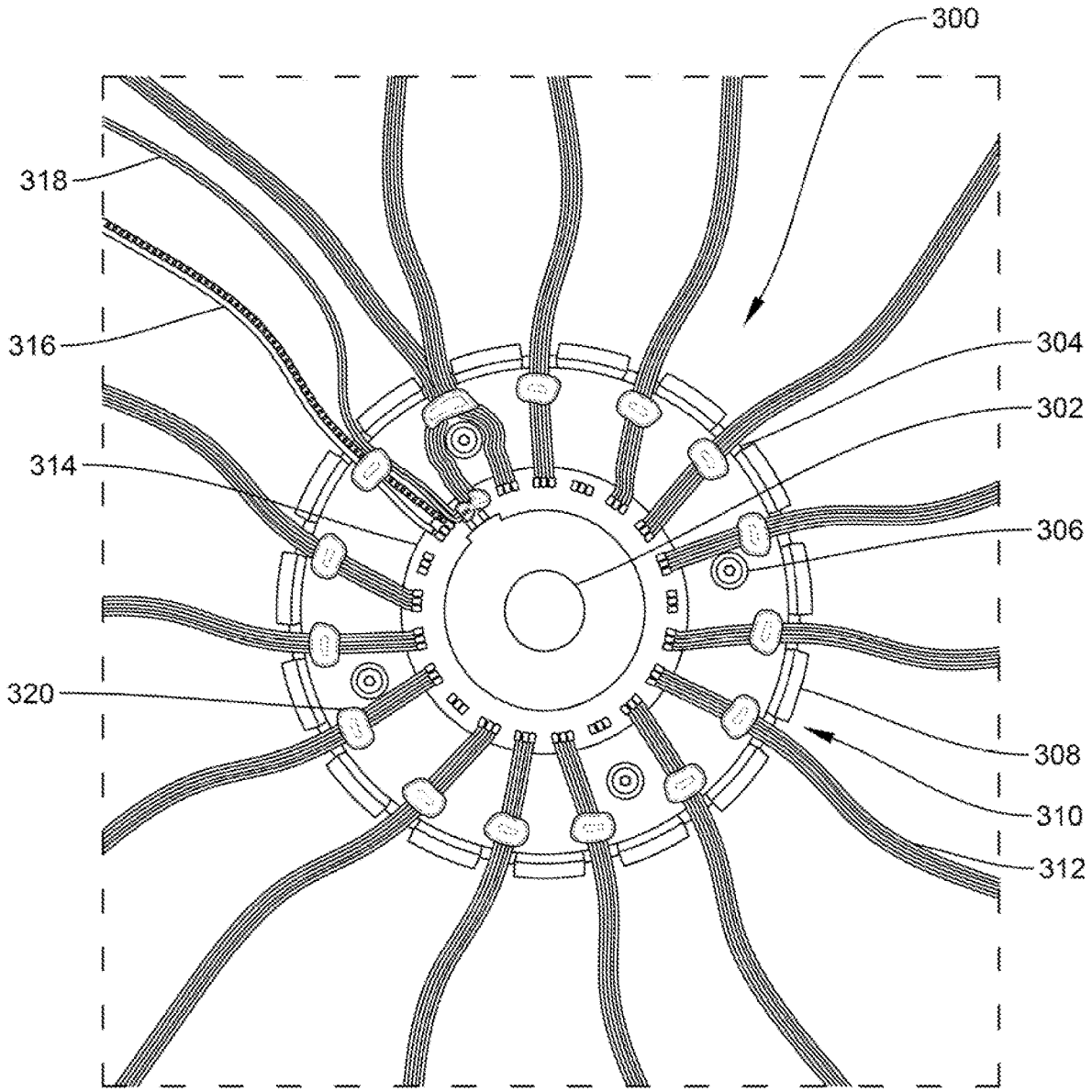
FIG. 3 is a top elevational view of a base of a flagpole lighting assembly, according to one embodiment of the invention.

FIG. 3 is a top elevational view of a base 300 of a flagpole lighting assembly, according to one embodiment of the invention. As shown, the base 300 is the electrical hub of the flagpole lighting assembly, such that it houses and protects the sensitive components.

The illustrated base 300 is shown as being ring-shaped and has a central aperture 302 therethrough. The aperture 302 is shown as being centrally located within the circumferential region 304, however such an orientation is not in every embodiment. The aperture 302 allows the device to be fastened to a pole or other device through a mount without necessitating a connecter be implemented on the base 300. In some embodiments, a connector may be implemented on the base 300 such that a separate connecter is unnecessary.

The base 300 further includes a series of protrusions 306 which are shown to be ring shaped and extend upwards from the base 300. The protrusions 306 are designed as mounts to connect the base 300 to a cover in order to enclose and protect the components within. The protrusions have a central aperture such that a fastener may be used to connect to the protrusion.

The base 300 as shown further includes a circumferential region 304 defining an exterior of the base 300. The circumferential area 304 is shown to have a plurality of tabs 308 extending upwards from the base. There are shown cutouts 310 between the tabs 308 which allow the lighted strands 312 to exit the enclosure.

There is shown a ring-shaped circuit board 314 affixed to the base and surrounding the aperture 302 to which the lighted strands 312, input cable 316 and output cable 318 are connected. The circuit board need not always be ring shaped in other embodiments, as it may be any number of shapes and/or sizes. The lighted strands 312, input cable 316 and output cable 318 are shown affixed to the base via a connector 320 such that each of the cables are not pulled out from the circuit board 314 if tension is placed on the cables. The connector 320 is shown as an adhesive, however, may be a mechanical fastener, friction fit connector, or any other similar connector in other embodiments.

Figure 4:
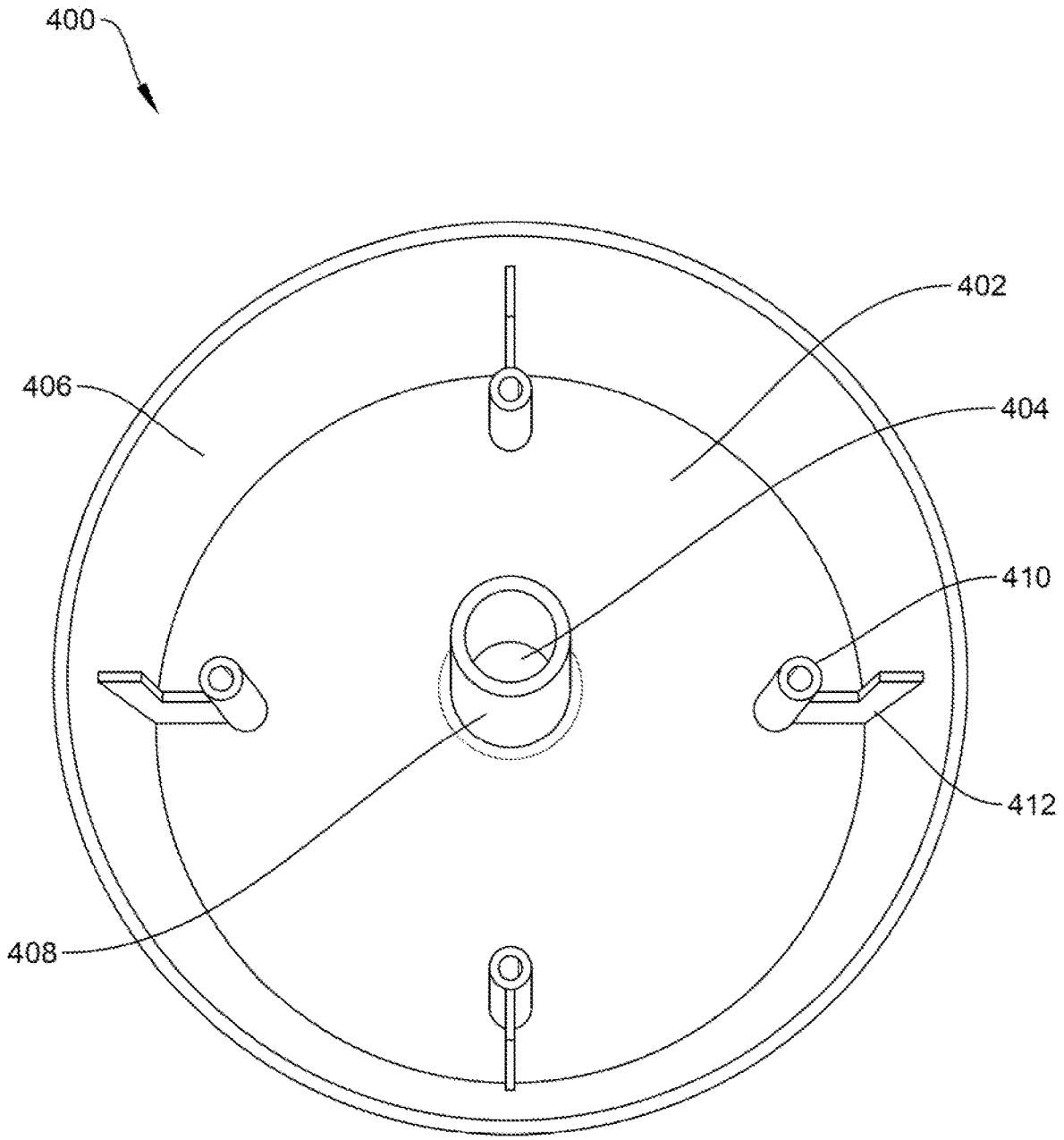
FIG. 4 is a bottom elevational view of a cover of a flagpole lighting assembly, according to one embodiment of the invention.

FIG. 4 is a bottom elevational view of a cover 400 of a flagpole lighting assembly, according to one embodiment of the invention. As shown, the cover 400 mounts to the base of the flagpole lighting assembly, such that the base is protected from the elements or outside damage.

The illustrated cover 400 is shown to include a top 402 with a central aperture 404 therethrough. As with the aperture on the base, the central aperture 404 on the cover 400 need not be centrally located, however should line up with the aperture on the base such that the enclosure may be mounted via the mount to the pole through each of the apertures on the base and the cover.

The cover 400 is shown to have an outer wall 406 extending downward from the top 402. The outer wall 406 has a larger diameter than the circumferential region of the base, and the outer wall 406 extends far enough such that the outer wall 406 covers the outside of the tabs of the base when the cover 400 is connected to the base. In some embodiments, the outer wall 406 may extend further, such that the outer wall 406 fully covers the outer circumference of the base when connected.

Further, the cover 400 includes an inner wall 408 extending downward from the top 402 and around the central aperture 404. The inner wall 408 extends further than the outer wall 406, such that the inner wall 408 extends into and/or through the central aperture in the base. In other embodiments, the inner wall 408 does not extend further than the outer wall 406, rather it extends the same length or a shorter length and does not go into nor through the aperture of the base.

The cover 400 also includes a series of protrusions 410 which are shown to be ring shaped and extend downwards from the top 402 of the cover 400. The protrusions 410 are designed as mounts to connect the cover 400 to a base in order to enclose and protect the components within the base. The protrusions 410 have a central aperture such that a fastener may be used to connect to the protrusion 410. The protrusions 410 further have a brace 412 which connects to the outer wall 406 of the cover 400. The brace 412 helps stabilize the protrusion 410 such that it is less susceptible to bending out of alignment or to any other damage.

Figure 5:
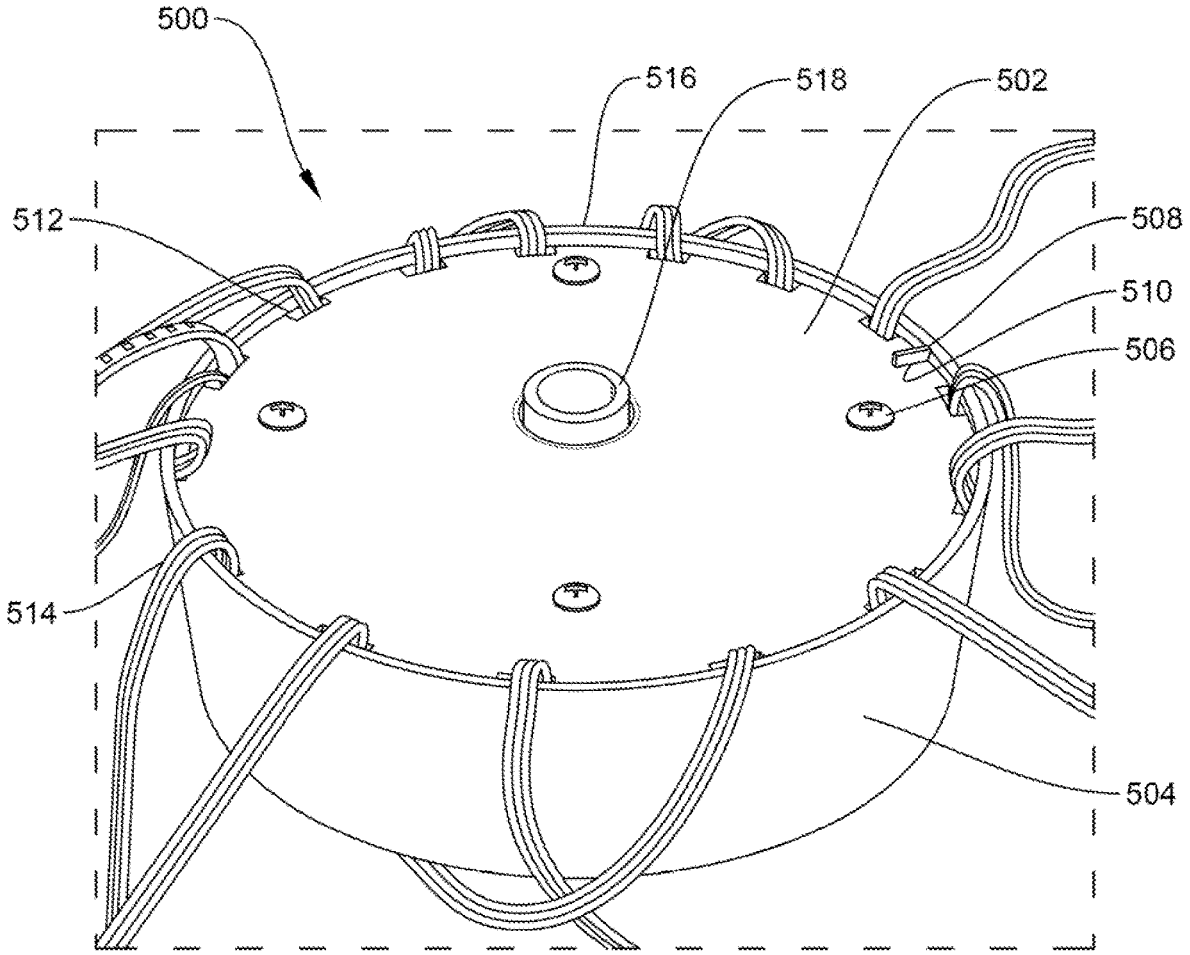
FIG. 5 is a bottom perspective view of an enclosure of a flagpole lighting assembly, according to one embodiment of the invention.

FIG. 5 is a bottom perspective view of an enclosure 500 of a flagpole lighting assembly, according to one embodiment of the invention. As shown the base 502 and cover 504 are connected such that the enclosure 500 is assembled. Accordingly, the enclosure is ready to mount to a pole.

As shown, the base 502 and cover 504 are connected through their respective apertures by fasteners 506 such that they are held together. There is seen a orienting tab 508 which goes into a slot 510 which ensures the base 502 and cover 504 are oriented correctly. In other embodiments, there may be different fasteners or there may not be an orienting tab 508 or slot 510.

The cutouts 512 on the base are seen with the respective lighted wires 514 and other wires extending out of the cutouts 512. The illustrated angle of the assembled enclosure 500 shows how the inner wall 518 and outer wall 516 extend past the base 502 to help weatherproof the device without having an airtight seal.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A flagpole lighting assembly, comprising:

a. a toroidal enclosure, including:

a. a ring-shaped base having an aperture therethrough, including:

i. a circumferential region; and ii. a bottom aperture interior to the circumferential region;

b. a cover, including:

i. a top with a top aperture therethrough;

ii. an outer wall circumferentially coupled to the top, with a larger diameter than a diameter of the circumferential region of the base, protruding downwards beyond the base; and iii. a tubular inner wall extending downward from the aperture and protruding through and beyond the bottom aperture;

b. a ring-shaped circuit board disposed within the toroidal enclosure;

c. a plurality of output lighted strands functionally coupled to the circuit board and extending therefrom; and d. a power wire functionally coupled to the circuit board.

2. The lighting assembly of claim 1, wherein the enclosure includes a plurality of tabs extending upwards from the circumferential region.

3. The lighting assembly of claim 1, wherein the base includes a plurality of ring-shaped protrusions extending upwards from the base and including an aperture in the center thereof.

4. The lighting assembly of claim 1, wherein the cover includes a plurality of mounts.

5. The lighting assembly of claim 4, wherein the cover mounts connect the cover to the enclosure.

6. The lighting assembly of claim 5, wherein the mounts are a plurality of protrusions extending downward from the top.

7. The lighting assembly of claim 6, wherein each protrusion has a brace connected to the outer wall.

8. The lighting assembly of claim 1, wherein the circumferential region includes a plurality of cutouts therein.

9. The lighting assembly of claim 1, wherein the base includes a plurality of ring-shaped protrusions extending upwards from the base.

10. The lighting assembly of claim 9, wherein the ring-shaped protrusions include an aperture in the center thereof.

11. A flagpole lighting assembly, comprising:

a. an enclosure, including:

a. a ring-shaped base having an aperture therethrough, including:

i. a circumferential region; and ii. a bottom aperture interior to the circumferential region;

b. a cover, including:

i. a top with an aperture therethrough;

ii. an outer wall circumferentially coupled to the top, with a larger diameter than a diameter of the circumferential region of the base, protruding downwards beyond the base;

iii. a primary protrusion extending from the top such that it is flush with the outer wall and including an aperture therethrough; and iv. a plurality of secondary protrusions extending downward from the top, each protrusion having a brace connected to the outer wall;

b. a ring-shaped circuit board; and c. a plurality of output lighted strands connected to the circuit board.

12. The lighting assembly of claim 11, wherein the base includes a plurality of tabs extending upwards from the circumferential region.

13. The lighting assembly of claim 12, wherein the base includes a plurality of ring-shaped protrusions extending upwards from the base.

14. The lighting assembly of claim 13, wherein the ring-shaped protrusions include an aperture in the center thereof.

15. The lighting assembly of claim 14, wherein the enclosure includes a plurality of ring-shaped protrusions extending upwards from the base and including an aperture in the center thereof.

16. The lighting assembly of claim 15, wherein the enclosure is toroidal.

17. The lighting assembly of claim 16, wherein the board is disposed within the enclosure.

18. The lighting assembly of claim 17, further including an input wire connected to the circuit board.

19. The lighting assembly of claim 18, further including a power wire connected to the circuit board.

20. A flagpole lighting assembly, comprising:

a. an enclosure, including:

a. a ring-shaped base having an aperture therethrough, including:

i. a circumference having a plurality of cutouts therein;

ii. a plurality of tabs extending upwards from the circumference;

iii. a plurality of ring-shaped protrusions extending upwards from the base and including an aperture in the center thereof; and iv. a central aperture;

b. a cover, including:

i. a top with an aperture therethrough;

ii. an outer wall with a larger diameter than the circumference and extending downwards past the base;

iii. a primary protrusion extending from the top such that it is flush with the outer wall and including an aperture therethrough; and iv. a plurality of secondary protrusions extending downward from the top, each protrusion having a brace connected to the outer wall;

b. a ring-shaped circuit board;

c. a plurality of output lighted strands connected to the circuit board; and an input wire connected to the circuit board.

* * * * *